US010010920B2

(12) United States Patent
Ren et al.

(10) Patent No.: US 10,010,920 B2
(45) Date of Patent: Jul. 3, 2018

(54) METHOD TO IMPROVE GEOMETRICAL ACCURACY OF AN INCREMENTALLY FORMED WORKPIECE

(71) Applicant: Ford Global Technologies, LLC, Dearborn, MI (US)

(72) Inventors: Feng Ren, Canton, MI (US); Zhiyong Cedric Xia, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 14/300,586

(22) Filed: Jun. 10, 2014

(65) Prior Publication Data

US 2014/0283571 A1 Sep. 25, 2014

Related U.S. Application Data

(62) Division of application No. 12/843,990, filed on Jul. 27, 2010, now Pat. No. 8,783,078.

(51) Int. Cl.
*B21D 31/00* (2006.01)
*B21D 5/01* (2006.01)

(52) U.S. Cl.
CPC ..... *B21D 5/01* (2013.01); *B21D 31/00* (2013.01); *B21D 31/005* (2013.01)

(58) Field of Classification Search
CPC ..... B21D 31/005; B21D 22/14; B21D 22/16; B21D 22/18; B21D 22/185; B21D 5/01; Y10T 29/47; Y10T 29/474
USPC ..... 72/83, 85, 112, 115, 124–126, 380, 384, 72/465.1, 470
See application file for complete search history.

(56) References Cited

U.S. PATENT DOCUMENTS

| | | | | |
|---|---|---|---|---|
| 2,762,417 | A | 9/1956 | Oeckl | |
| 2,945,528 | A | 7/1960 | Roux | |
| 3,342,051 | A | 9/1967 | Leszak | |
| 3,875,382 | A | 4/1975 | Cutler | |
| 4,055,976 | A * | 11/1977 | Kraft | 72/83 |
| 4,212,188 | A | 7/1980 | Pinson | |
| 5,103,558 | A | 4/1992 | Herrick et al. | |
| 5,392,663 | A | 2/1995 | Charles | |
| 6,151,938 | A | 11/2000 | Park et al. | |
| 6,216,508 | B1 | 4/2001 | Matsubara et al. | |
| 6,532,786 | B1 | 3/2003 | Luttgeharm | |
| 6,561,002 | B2 | 5/2003 | Okada et al. | |
| 6,971,256 | B2 | 12/2005 | Okada et al. | |

(Continued)

FOREIGN PATENT DOCUMENTS

| | | |
|---|---|---|
| CN | 102198464 A | 9/2011 |
| CN | 102319788 A | 1/2012 |

(Continued)

OTHER PUBLICATIONS

Machine Translation of JP 11-300424A, Shima et al, Nov. 2, 1999.*

(Continued)

*Primary Examiner* — Debra Sullivan
(74) *Attorney, Agent, or Firm* — Marla Johnston; Brooks Kushman P.C.

(57) ABSTRACT

A method of incrementally forming a workpiece. The method may include incrementally forming a stiffening feature on the workpiece and incrementally forming a part on the workpiece. A gap between forming tools may be decreased to reform the part.

20 Claims, 3 Drawing Sheets

(56) References Cited

U.S. PATENT DOCUMENTS

| | | | |
|---|---|---|---|
| 7,467,535 | B2 | 12/2008 | Kuno et al. |
| 7,536,892 | B2 | 5/2009 | Amino et al. |
| 7,971,463 | B2 | 7/2011 | Forrest et al. |
| 8,033,151 | B2 | 10/2011 | Castle et al. |
| 8,302,442 | B2 | 11/2012 | Kiridena et al. |
| 8,316,687 | B2 | 11/2012 | Slattery |
| 8,322,176 | B2 | 12/2012 | Johnson et al. |
| 8,408,039 | B2 | 4/2013 | Cao et al. |
| 8,578,748 | B2 | 11/2013 | Huskamp et al. |
| 8,631,677 | B2 | 1/2014 | Fukuzako et al. |
| 8,733,143 | B2 | 5/2014 | Kiridena et al. |
| 8,783,078 | B2 | 7/2014 | Ren et al. |
| 8,858,853 | B2 | 10/2014 | Huskamp et al. |
| 8,956,140 | B2 | 2/2015 | Hartmann |
| 9,050,647 | B2 | 6/2015 | Thomas et al. |
| 9,149,987 | B2 | 10/2015 | Hartmann |
| 9,192,981 | B2 | 11/2015 | Forbes Jones et al. |
| 9,206,497 | B2 | 12/2015 | Bryan et al. |
| 9,255,316 | B2 | 2/2016 | Bryan |
| 9,409,349 | B2 | 8/2016 | Huskamp et al. |
| 9,523,137 | B2 | 12/2016 | Marquardt et al. |
| 2001/0029768 | A1 | 10/2001 | Okada et al. |
| 2004/0148997 | A1 | 8/2004 | Amino et al. |
| 2004/0187545 | A1 | 9/2004 | Okada et al. |
| 2004/0187548 | A1 | 9/2004 | Okada et al. |
| 2006/0090530 | A1 | 5/2006 | Hammer et al. |
| 2006/0272378 | A1 | 12/2006 | Amino et al. |
| 2007/0000299 | A1 | 1/2007 | Kuno et al. |
| 2008/0302154 | A1 | 12/2008 | Forrest et al. |
| 2009/0158805 | A1 | 6/2009 | Callebaut et al. |
| 2009/0250834 | A1 | 10/2009 | Huskamp et al. |
| 2010/0092796 | A1 | 4/2010 | Cao et al. |
| 2010/0199742 | A1 | 8/2010 | Johnson et al. |
| 2010/0257909 | A1 | 10/2010 | Huskamp et al. |
| 2010/0257910 | A1 | 10/2010 | Castle et al. |
| 2010/0260569 | A1 | 10/2010 | Ham et al. |
| 2011/0036139 | A1 | 2/2011 | Slattery |
| 2011/0154875 | A1 | 6/2011 | Fukuzako et al. |
| 2013/0199444 | A1 | 8/2013 | Hartmann |
| 2014/0260492 | A1 | 9/2014 | Thomas et al. |

FOREIGN PATENT DOCUMENTS

| | | | | |
|---|---|---|---|---|
| DE | 10324244 | A1 | | 12/2004 |
| DE | 102005024378 | A1 | | 11/2006 |
| DE | 102006016460 | A1 | | 10/2007 |
| DE | 102007023269 | A1 | | 11/2008 |
| DE | 102008004051 | A1 | | 7/2009 |
| DE | 102006002146 | B4 | | 7/2011 |
| DE | 102005024378 | B4 | | 2/2016 |
| EP | 1731238 | A1 | | 12/2006 |
| EP | 1899089 | A2 | | 3/2008 |
| EP | 2085164 | A1 | | 8/2009 |
| JP | S5614031 | A | | 2/1981 |
| JP | H0531537 | A | | 2/1993 |
| JP | H07132329 | A | | 5/1995 |
| JP | H0910855 | A | | 1/1997 |
| JP | 09085355 | A | * | 3/1997 |
| JP | H11300424 | A | | 11/1999 |
| WO | 8901370 | A1 | | 2/1989 |
| WO | 2004105976 | A1 | | 12/2004 |
| WO | 2007082972 | A1 | | 7/2007 |

OTHER PUBLICATIONS

"Principle and applications of multi-point matched-die forming for sheet metal," by M-Z Li-, Z-Y Cal, Z. Sui, and X-J Li, Jilin University, Changchun, People's Republic of China, Jan. 9, 2008.

"Dieless Incremental Sheet Metal Forming Technology," Applied Plasticity Research Group, publication date unknown.

"Dieless NC Forming," www.the fabricator.com, by Taylan Altan, Jun. 12, 2003.

"Dieless Sheet Forming," Se-Prof Technology Services Ltd., printed Oct. 16, 2008, publication date unknown.

"Octahedral Hexapod Design Promises Enhanced Machine Performance," Ingersoll Milling Machine Company, printed Oct. 7, 2008, publication date unknown.

"A Computer Numerically Controlled Dieless Incremental Forming of a Sheet Metal," by S. Matsubara, University of Industrial Technology, Sagamihara-shi, Japan, May 25, 2001.

"Incremental Forming of Sheet Metal," by J. Cao, V. Reddy and Y. Wang, Northwestern University, publication date unknown.

"Sheet Metal Dieless Forming and its tool path generation based on STL files," by L. .Jie, M. Jianhua, and H. Shuhual; Springer London, Feb. 19, 2004.

"A review of conventional and modern single-point sheet metal forming methods," by E. Hagan and J. Jeswlet, Queen's University, Kingston, Ontario, Canada, Sep. 19, 2002.

"Investigation into a new incremental forming process using an adjustable punch set for the manufacture of a double curved sheet metal," by S. J. Yoon and D. Y. Yang; Korea Advanced Institute of Science of Technology; Taejon, Korea; Feb. 5, 2001.

First Office Action dated Jun. 25, 2014 for corresponding Chinese Application CN201110169440.6; 3 pages.

* cited by examiner

METHOD TO IMPROVE GEOMETRICAL ACCURACY OF AN INCREMENTALLY FORMED WORKPIECE

CROSS-REFERENCE TO RELATED APPLICATIONS

This application is a division of U.S. application Ser. No. 12/843,990, filed Jul. 27, 2010, now U.S. Pat. No. 8,783,078, the disclosure of which is hereby incorporated in its entirety by reference herein.

BACKGROUND

Technical Field

The present invention relates to a method of incrementally forming a workpiece.

SUMMARY

In at least one embodiment a method of incrementally forming a workpiece is provided. The method includes incrementally forming a stiffening feature on the workpiece and incrementally forming a part on the workpiece within the stiffening feature.

In at least one embodiment a method of incrementally forming a workpiece is provided. The method includes incrementally forming a stiffening feature on the workpiece and incrementally forming a part on the workpiece outwardly from the stiffening feature.

In at least one embodiment a method of incrementally forming a workpiece is provided. The method includes incrementally forming a part on the workpiece with first and second forming tools disposed on opposite sides of the workpiece. A gap between the first and second forming tools may be decreased when at least a portion of the part is reformed with the first and second forming tools.

DETAILED DESCRIPTION

Detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. In addition, any or all features from one embodiment may be combined with any other embodiment. Therefore, specific structural and functional details disclosed herein are not to be interpreted as limiting, but merely as a representative basis for the claims and/or as a representative basis for teaching one skilled in the art to variously employ the present invention.

Figure 1:
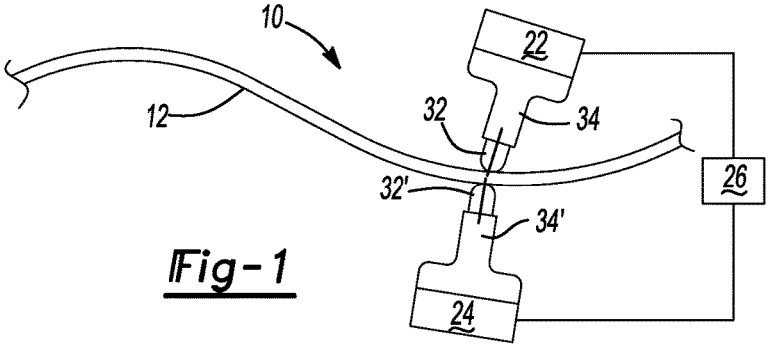
FIG. 1 is an exemplary side view of an incremental forming system for forming a workpiece.
Figure 2:
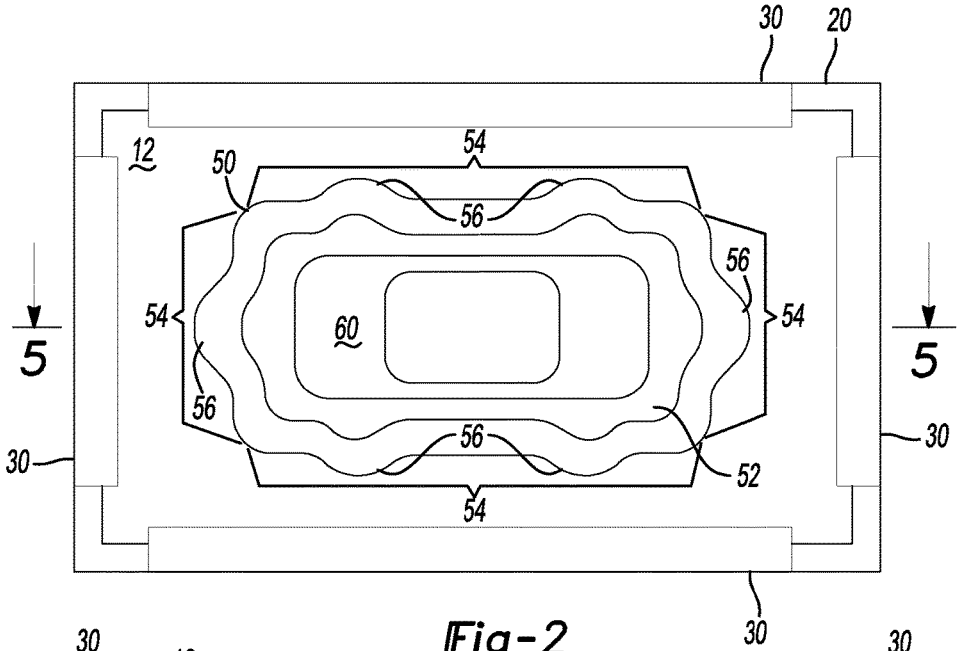
FIG. 2 is a top view of a portion of an incremental forming system and an embodiment of a workpiece.

Referring to FIGS. 1 and 2, an exemplary system 10 for incrementally forming a workpiece 12 is shown. The workpiece 12 may be made of any suitable material or materials that have desirable forming characteristics, such as a metal, metal alloy, polymeric material, or combinations thereof. In at least one embodiment, the workpiece 12 may be provided as sheet metal. The workpiece 12 may be provided in an initial configuration that is generally planar or that is at least partially preformed into a non-planar configuration in one or more embodiments.

The system 10 may be used to incrementally form a workpiece. In incremental forming, a workpiece is formed into a desired configuration by a series of small incremental deformations. The small incremental deformations may be provided by moving one or more tools along and against one or more surfaces of the workpiece. Tool movement may occur along a predetermined or programmed path. In addition, a tool movement path may be adaptively programmed in real-time based on measured feedback, such as from a sensor like a load cell. Thus, incremental forming may occur in increments as at least one tool is moved and without removing material from the workpiece. More details of such a system 10 are described in U.S. patent application Ser. No. 12/369,336, which is assigned to the assignee of the present application and is hereby incorporated by reference in its entirety. A brief summary of some components that may be provided with such a system 10 is provided below.

The system 10 may include a plurality of components that facilitate forming of the workpiece 12, such as a fixture assembly 20, a first manipulator 22, a second manipulator 24, and a controller 26.

The fixture assembly 20 may be provided to support the workpiece 12. The fixture assembly 20 may be configured as a frame that at least partially defines an opening 28. The workpiece 12 may be disposed in or at least partially cover the opening 28 when the workpiece 12 is received by the fixture assembly 20.

The fixture assembly 20 may include a plurality of clamps 30 that may be configured to engage and exert force on the workpiece 12. The clamps 30 may be provided along multiple sides of the opening 28 and may have any suitable configuration and associated actuation mechanism. For instance, the clamps 30 may be manually, pneumatically, hydraulically, or electrically actuated. Moreover, the clamps 30 may be configured to provide a fixed or adjustable amount of force upon the workpiece 12.

First and second positioning devices or manipulators 22, 24 may be provided to position first and second forming tools 32, 32'. The first and second manipulators 22, 24 may have multiple degrees of freedom, such as hexapod manipulators that may have at least six degrees of freedom. The manipulators 22, 24 may be configured to move an associated tool along a plurality of axes, such as axes extending in different orthogonal directions like X, Y and Z axes.

The first and second forming tools 32, 32' may be received in first and second tool holders 34, 34', respectively. The first and second tool holders 34, 34' may be disposed on a spindle and may be configured to rotate about an associated axis of rotation in one or more embodiments.

The forming tools 32, 32' may impart force to form the workpiece 12 without removing material. The forming tools 32, 32' may have any suitable geometry, including, but not limited to flat, curved, spherical, or conical shape or combinations thereof.

One or more controllers 26 or control modules may be provided for controlling operation of the system 10. The controller 26 may be adapted to receive computer aided design (CAD) or coordinate data and provide computer numerical control (CNC) to form the workpiece 12 to design specifications. In addition, the controller 26 may monitor and control operation of a measurement system that may be provided to monitor dimensional characteristics of the workpiece 12 during the forming process.

An unsupported portion of a workpiece, such as a flat piece of sheet metal, may sag or deform under its own weight in a fixture assembly. Such sagging or deformation may cause significant deviations between the actual dimensional characteristics of an incrementally formed part and the desired or design-intent configuration. In addition, residual stresses in an incrementally formed workpiece can result in unintended deformation that may cause dimensional inaccuracies. Dimensional inaccuracies may accumulate as a workpiece is formed. Such accumulated stresses may cause a workpiece to buckle or split. Residual stresses may cause a workpiece to change shape when forming tools move away from the workpiece or when released from fixture assembly clamps.

To help address one or more of the issues described above, one or more methods of incremental forming as described below may be used to form a workpiece. The method may employ forming tools that are disposed on opposite sides of a workpiece.

Referring to FIG. 2, a top view of an exemplary workpiece 12 disposed in a fixture assembly 20 is shown. The workpiece in FIG. 2 is shown in a final configuration after incremental forming is completed.

Figure 3:
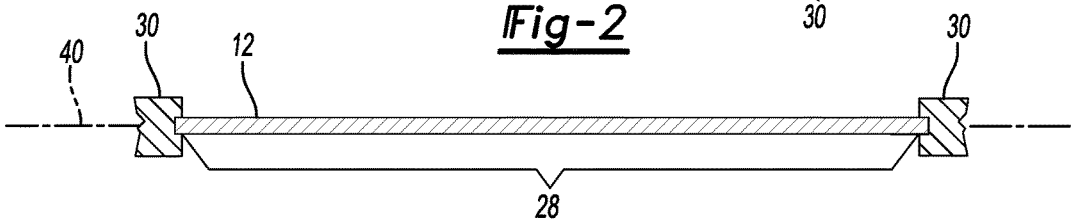
FIGS. 3-5 are exemplary side section views of the workpiece of FIG. 2 being incrementally formed.
Figure 4:
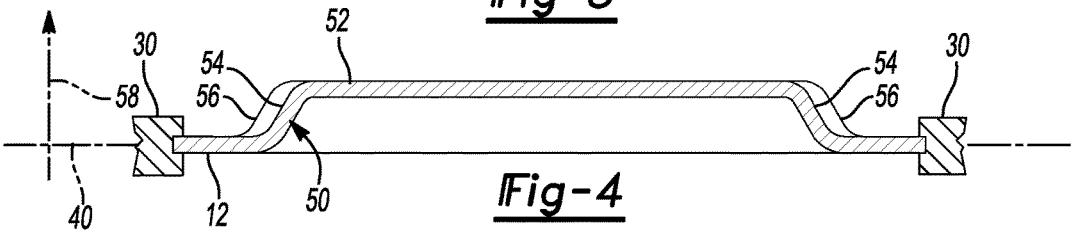
Figure 5:
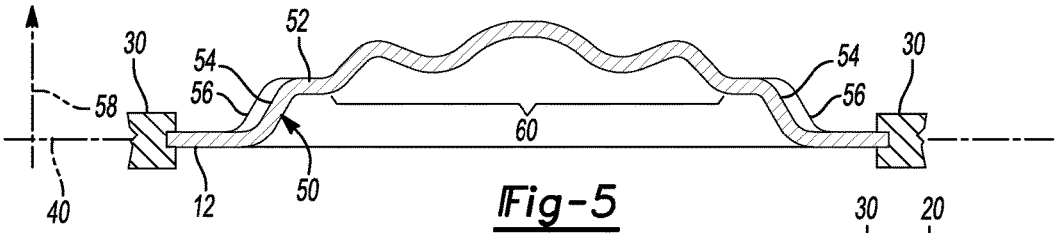

Referring to FIGS. 3-5, an exemplary method of incrementally forming a workpiece is illustrated. More specifically, FIGS. 3-5 are section views of the workpiece 12 during different stages of incremental forming along section line 5-5 in FIG. 2.

Referring to FIG. 3, the workpiece 12 is shown in an initial configuration. The initial configuration of the workpiece 12 may be the configuration or shape of the workpiece 12 prior to incremental forming. In at least one embodiment, the initial configuration may be substantially planar as shown. As such, the workpiece 12 may be at least partially disposed along or substantially parallel to a reference plane 40 in one or more embodiments.

Referring to FIG. 4, the workpiece 12 is shown after incrementally forming a stiffening feature 50 on the workpiece 12. The stiffening feature 50 may be spaced apart from the fixture assembly 20 and clamps 30. The stiffening feature 50 may at least partially extend around a portion of the workpiece 12 in which a part may be formed. As is best shown in FIG. 2, the stiffening feature 50 may have a ring-like configuration that extends completely around or bounds a part forming area 52.

The stiffening feature 50 may include one or more sides 54 that may be tapered or extend at an angle away from the reference plane 40. In addition, each side 54 may include one or more areas of curvature 56. The areas of curvature 56 may be formed along a tapered side 54 and may provide additional structural support or rigidity to the part forming area 52. The sides 54 may be tapered at a common angle relative to the reference plane 40. Moreover, opposing sides may have the same configuration.

The stiffening feature 50 may be partially or completely formed in a first direction 58 with respect to the fixture assembly 20 and/or the reference plane 40. The first direction 58 may extend along an axis that may be substantially perpendicular to the unformed workpiece 12 and/or reference plane 40. In addition, a majority of the stiffening feature 50 may be formed in a direction that coincides with a direction in which a majority of a part 60 is formed with respect to the fixture assembly 20 and/or the reference plane 40.

Referring to FIG. 5, the workpiece 12 is shown after incrementally forming the part 60 on the workpiece 12. The part 60 may be incrementally formed in the part forming area 52. Moreover, the part 60 may be spaced apart from the stiffening feature 50 such that at least a portion of the workpiece 12 disposed between the stiffening feature 50 and the part 60 is not incrementally formed. The part 60 may be incrementally formed to a desired configuration in a manner as previously discussed.

The tool feed rate for incrementally forming the part 60 may be slower than that used to incrementally form the stiffening feature 50. A slower tool feed rate may yield better surface finish quality and improved dimensional accuracy than a higher tool feed rate leaving other factors constant. Accordingly, a higher tool feed rate may reduce forming cycle time yet provide adequate finish or dimensional characteristics in various circumstances, such as when a stiffening feature 50 is not integral with the part 60. In addition, other incremental forming parameters may be changed in addition to or separately from increasing the tool feed rate. For example, the forming step size and tool tip size may be increased to accelerate the forming process. Moreover, portions of the workpiece may be reformed to improve surface finish and or dimensional accuracy if desired.

Figure 6:
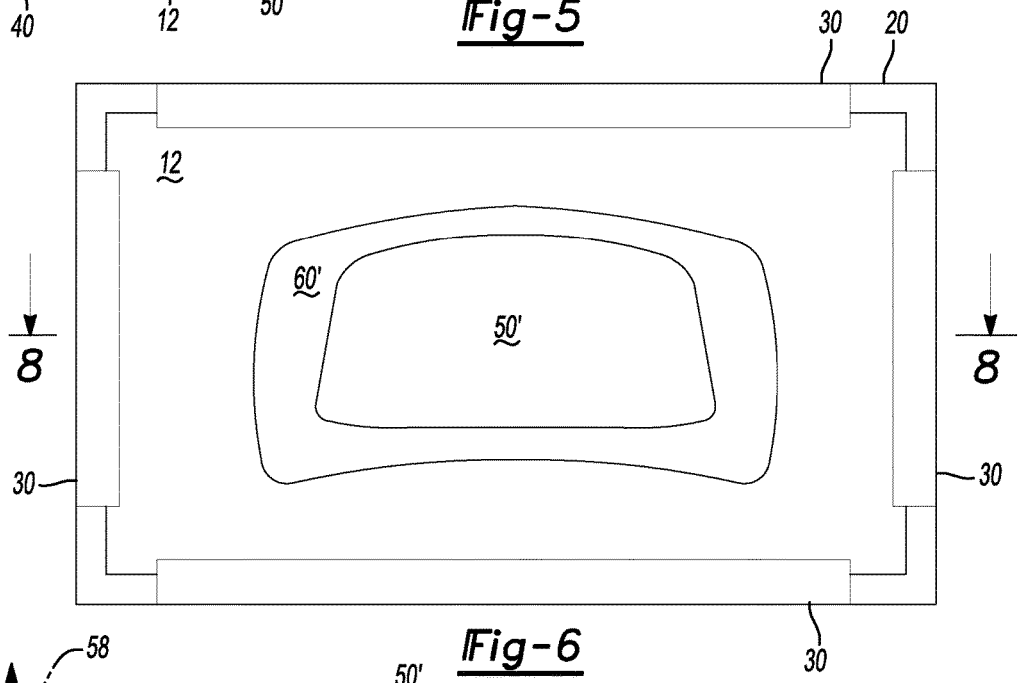
FIG. 6 is a top view of a portion of an incremental forming system and another embodiment of a workpiece.
Figure 7:
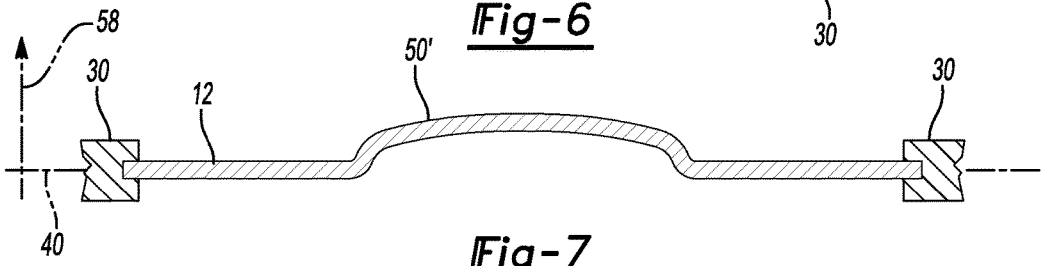
FIGS. 7 and 8 are exemplary side section views of the workpiece of FIG. 6 being incrementally formed.
Figure 8:
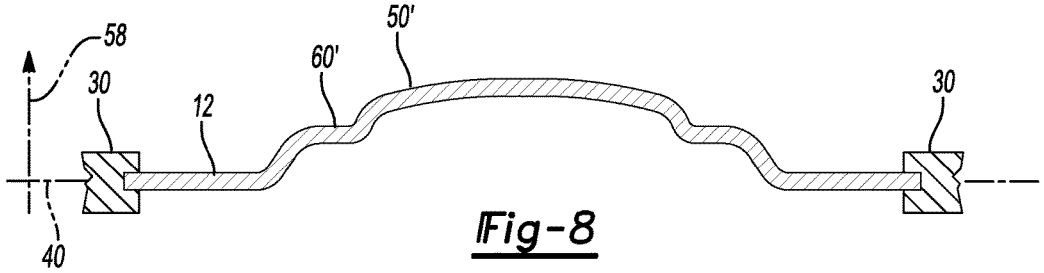

Referring to FIGS. 6-8, another example of a method of incrementally forming a workpiece is illustrated. More specifically, FIGS. 7 and 8 are section views of the workpiece 12 during different stages of incremental forming along section line 8-8 in FIG. 6. In addition, the workpiece 12 may be initially provided in an initial configuration as shown in FIG. 3 as previously discussed.

Referring to FIG. 7, the workpiece 12 is shown after incrementally forming a stiffening feature 50' on the workpiece 12. The stiffening feature 50' may be spaced apart from the fixture assembly 20 and clamps 30. In addition, the stiffening feature 50' may be partially or completely formed in a first direction 58 with respect to the fixture assembly 20 and/or the reference plane 40. In addition, a majority of the stiffening feature 50' may be formed in a direction that coincides with a direction in with a majority of a part 60' is formed with respect to the fixture assembly 20 and/or the reference plane 40.

Referring to FIG. 8, the workpiece 12 is shown after incrementally forming the part 60' on the workpiece 12. The part 60' may be incrementally formed between the stiffening feature 50' and the fixture assembly 20. In at least one embodiment, the part 60' may be incrementally formed completely around the stiffening feature 50'. Moreover, the part 60' may be contiguous with at least a portion of the stiffening feature 50'. As such, the part 60' may be positioned or incrementally formed outwardly from and continuously with the stiffening feature 50' in one or more embodiments. Positioning the stiffening feature 50' within the part 60' may result in the stiffening feature 50' being integral with the part 60' and may help prevent buckling or cracking of the workpiece 12 in the area in which the stiffening feature 50' is provided. Incremental forming of the part 60' outwardly from the stiffening feature may include locating the part 60' outward or around at least a portion of the stiffening feature 50' and/or executing at least a portion of an incremental forming tool path in a direction that moves outwardly away from the stiffening feature 50'.

The stiffening feature 50' may be initially formed at a faster tool feed rate than that used to incrementally form the part 60'. After the part 60' is formed, the stiffening feature 50' may be reformed at a slower feed rate to provide a desired surface finish and better integrate the stiffening feature 50' with the part 60'. The stiffening feature 50' may be formed to a desired geometry without subsequent reforming in one or more embodiments.

Figure 9:
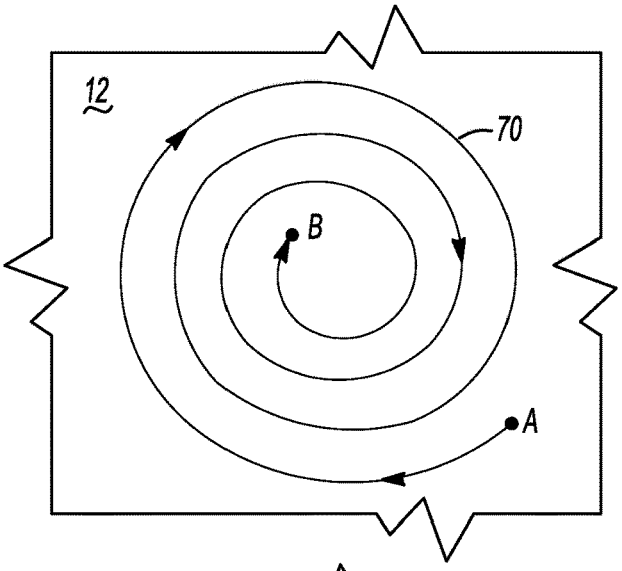
FIG. 9 is an exemplary tool path for incremental forming a workpiece.
Figure 10:
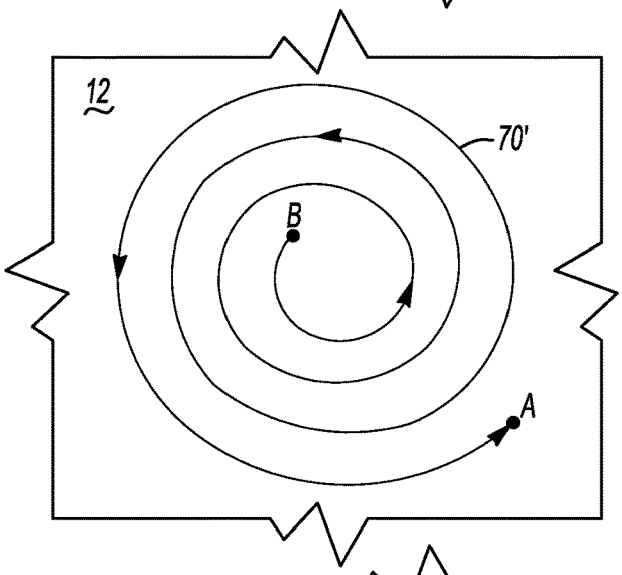
FIGS. 10 and 11 are different exemplary tool paths for reforming the workpiece of FIG. 9.
Figure 11:
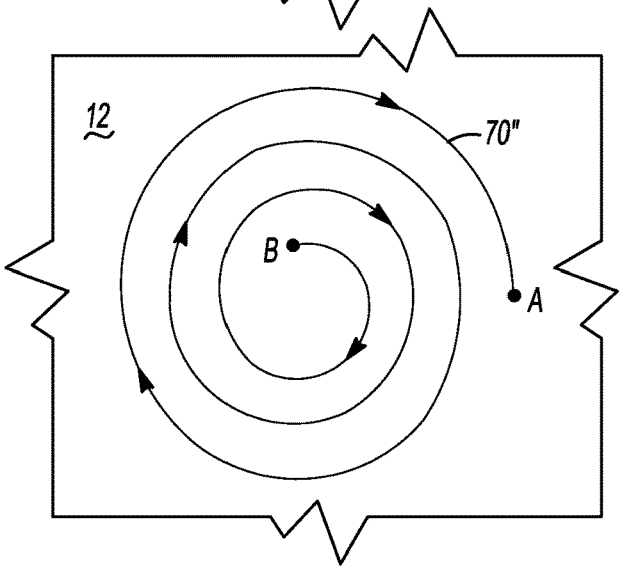

Referring to FIGS. 9-11, additional examples of methods of incrementally forming a workpiece are illustrated. The tool paths and their associated start and end points are merely exemplary in these Figures. For example, the start point and end point for each tool path may be reversed.

FIG. 9 illustrates a top view of an exemplary tool path for incrementally forming a workpiece 12. The tool path 70 extends from a start position designated point A to an end position designated point B. The tool path 70 may be a spiral tool path and may not be disposed in a plane in one or more embodiments. In addition, the start point A and end point B may be swapped. The tool path 70 may refer to a path of movement of one or more forming tools 32, 32' during incremental forming of the workpiece.

Referring to FIGS. 10 and 11, examples of tool paths that may be executed after traversing the tool path from point A to point B are shown. In both embodiments, one or more tools are moved from point B to point A. In addition, the gap or distance between incremental forming tools 32, 32' disposed on opposite side of the workpiece 12 may be decreased when moving from point B to point A relative to a gap between the tools 32, 32' when traversing from point A to point B. Movement along such tool paths in this manner may reduce residual stresses in the workpiece 12 and reduce spring back.

Referring to FIG. 10, the tool path 70' from point B to point A is substantially identical as the tool path 70 in FIG. 9 except that the direction of movement is reversed. In other words, the configuration of the tool path is substantially the same in FIGS. 9 and 10, but movement is in the opposite direction (i.e., from point B to point A) in FIG. 10.

Referring to FIG. 11, the tool path 70" from point B to point A is not identical to that shown in FIG. 9. In FIG. 11, the tool path 70" is a spiral tool path in which movement is in a different rotational direction as compared to FIG. 9. For instance, tool path 70 in FIG. 9 is in a first rotational direction, illustrated as being in a clockwise direction, while the tool path 70" in FIG. 11 is in a second rotational direction, illustrated as being is in a counterclockwise direction.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed:

1. A method comprising:

incrementally forming a part on a workpiece with first and second forming tools that move along multiple axes along opposite sides of the workpiece from start to end positions at a first gap therebetween; and after completely forming the part, reforming the part by moving the first and second forming tools from the end position to the start position with a second gap therebetween that is less than the first gap.

2. The method of claim 1 wherein the part is incrementally formed by moving the first and second forming tools along a tool path between the start position and the end position.

3. The method of claim 2 wherein the part is incrementally formed by moving the first and second forming tools along the tool path from the start position to the end position and the part is reformed by moving the first and second forming tools along the tool path from the end position to the start position.

4. The method of claim 3 wherein the tool path is a spiral tool path.

5. The method of claim 2 wherein the second gap between the first and second forming tools when moving from the end position to the start position is less than the first gap between the first and second forming tools when moving from the start position to the end position reduces spring back of the workpiece.

6. The method of claim 1 wherein reforming at the second gap reduces residual stress in the workpiece.

7. The method of claim 1 wherein the part is incrementally formed by moving the first and second forming tools along a first spiral tool path from start to end positions and the part is reformed by moving the first and second forming tools along a second spiral tool path from the end position to the start position.

8. The method of claim 7 wherein the first spiral tool path differs from the second spiral tool path.

9. The method of claim 7 wherein movement along the first spiral tool path is in a first rotational direction and movement along the second spiral tool path is in a second rotational direction that differs from the first rotational direction.

10. The method of claim 7 wherein the second gap between the first and second forming tools when moving from the end position to the start position is less than the first gap between the first and second forming tools when moving from the start position to the end position reduces spring back of the workpiece.

11. The method of claim 1 further comprising incrementally forming a stiffening feature on the workpiece before incrementally forming the part.

12. The method of claim 11 wherein the part is incrementally formed within the stiffening feature after completely incrementally forming the stiffening feature.

13. The method of claim 12 wherein the stiffening feature is incrementally formed at a faster tool feed rate than the part.

14. The method of claim 11 wherein the part is incrementally formed outwardly from the stiffening feature after incrementally forming the stiffening feature.

15. The method of claim 14 wherein the stiffening feature is incrementally formed at a faster tool feed rate than the part.

16. A method comprising:

incrementally forming a part on a workpiece with first and second forming tools moveable along multiple axes along opposite sides of the workpiece from a start position to an end position at a first gap measured from where the first and second forming tools engage the opposite sides of the workpiece under control of an electronic controller; and decreasing the first gap to a second gap after completing incremental forming of the part, then reforming at least a portion of the part from the end position toward the start position at the second gap with the first and second forming tools.

17. The method of claim 16 wherein the part is incrementally formed by moving the first and second forming tools along a tool path between the start position and the end position.

18. The method of claim 17 wherein the part is incrementally formed by moving the first and second forming tools along the tool path from the start position to the end position and the part is reformed by moving the first and second forming tools along the tool path from the end position to the start position.

19. The method of claim 18 wherein the tool path is a spiral tool path.

20. The method of claim 16 wherein the part is incrementally formed by moving the first and second forming tools along a first spiral tool path from the start position to the end position and the part is reformed by moving the first and second forming tools along a second spiral tool path from the end position to the start position, wherein movement along the first spiral tool path is in a first rotational direction and movement along the second spiral tool path is in a second rotational direction that differs from the first rotational direction.

* * * * *